US011168899B2

(12) United States Patent
Dygert

(10) Patent No.: US 11,168,899 B2
(45) Date of Patent: Nov. 9, 2021

(54) VANE AXIAL FAN WITH INTERMEDIATE FLOW CONTROL RINGS

(71) Applicant: Carrier Corporation, Palm Beach Gardens, FL (US)

(72) Inventor: Ryan K. Dygert, Cicero, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 41 days.

(21) Appl. No.: 16/099,115

(22) PCT Filed: May 3, 2017

(86) PCT No.: PCT/US2017/030732

§ 371 (c)(1),
(2) Date: Nov. 5, 2018

(87) PCT Pub. No.: WO2017/192651

PCT Pub. Date: Nov. 9, 2017

(65) Prior Publication Data

US 2019/0211843 A1 Jul. 11, 2019

Related U.S. Application Data

(60) Provisional application No. 62/330,963, filed on May 3, 2016, provisional application No. 62/330,975, filed (Continued)

(51) Int. Cl.
*F04D 29/54* (2006.01)
*F24F 1/029* (2019.01)

(Continued)

(52) U.S. Cl.
CPC ..... *F24F 1/029* (2019.02); *F04D 19/002* (2013.01); *F04D 25/12* (2013.01); *F04D 29/34* (2013.01);

(Continued)

(58) Field of Classification Search
CPC .... F04D 29/544; F04D 29/541; F04D 29/542; F04D 29/667; F04D 19/002; F24F 1/0029
See application file for complete search history.

(56) References Cited

U.S. PATENT DOCUMENTS 2,189,767 A 2/1940 Vose
2,287,822 A 6/1942 Odor et al.

(Continued)

FOREIGN PATENT DOCUMENTS

DE 202004005026 U1 9/2004
EP 1895166 A1 3/2008

(Continued)

OTHER PUBLICATIONS

International Search Report for International Application No. PCT/US2017/030722; International Filing Date May 3, 2017; dated Jul. 14, 2017; 5 Pages.

(Continued)

*Primary Examiner* — Woody A Lee, Jr.
*Assistant Examiner* — Behnoush Haghighian
(74) *Attorney, Agent, or Firm* — Cantor Colburn LLP

(57) ABSTRACT

A fan assembly includes a shrouded fan rotor (18) having a plurality of fan blades (22) extending from a rotor hub (24) and rotatable about a central axis (20) of the fan assembly and a fan shroud (26) extending circumferentially around the fan rotor (18) and secured to an outer tip diameter of the plurality of fan blades (22). A stator assembly (28) is located downstream of the fan rotor (18), relative to an airflow (14) direction through the fan assembly. The stator assembly (28) includes a plurality of stator vanes (30) extending between a stator hub (32) and a stator shroud (34). A flow control ring (36) is positioned between the fan rotor (18) and the stator assembly (28) to block radial flow migration in an axial spacing between the fan rotor and the stator assembly (Continued)

resulting from a radial flow component of an airflow (14) exiting the fan rotor (18).

11 Claims, 4 Drawing Sheets

Related U.S. Application Data on May 3, 2016, provisional application No. 62/369,349, filed on Aug. 1, 2016.

(51) Int. Cl.

| | |
|---|---|
| ***F04D 29/66*** | (2006.01) |
| ***F24F 1/0323*** | (2019.01) |
| ***F24F 1/0287*** | (2019.01) |
| ***F04D 19/00*** | (2006.01) |
| ***F24F 1/0029*** | (2019.01) |
| ***F04D 25/12*** | (2006.01) |
| ***F04D 29/34*** | (2006.01) |
| ***F24F 13/20*** | (2006.01) |
| *F04D 29/38* | (2006.01) |
| *F04D 25/06* | (2006.01) |

(52) U.S. Cl.

CPC ..... *F04D 29/541* (2013.01); *F04D 29/542* (2013.01); *F04D 29/667* (2013.01); *F24F 1/0029* (2013.01); *F24F 1/0287* (2019.02); *F24F 1/0323* (2019.02); *F24F 13/20* (2013.01); *F04D 25/06* (2013.01); *F04D 29/38* (2013.01); *F04D 29/544* (2013.01); *F24F 2013/205* (2013.01)

(56) References Cited

U.S. PATENT DOCUMENTS

| | | | | |
|---|---|---|---|---|
| 2,293,718 | A | 8/1942 | Eberhart | |
| 3,229,896 | A | 1/1966 | Levy | |
| 3,415,074 | A | 12/1968 | Metcalfe | |
| 3,702,220 | A | 11/1972 | Medawar et al. | |
| 3,846,039 | A | 11/1974 | Stalker | |
| 3,883,264 | A * | 5/1975 | Rao | F01D 1/04 415/119 |
| 3,995,970 | A | 12/1976 | Nobuyuki | |
| 4,018,266 | A | 4/1977 | Kay | |
| 4,182,596 | A | 1/1980 | Wellman | |
| 4,566,852 | A | 1/1986 | Hauser | |
| 4,971,603 | A | 11/1990 | Prinsloo et al. | |
| 5,489,186 | A | 2/1996 | Yapp et al. | |
| 5,525,036 | A | 6/1996 | Park | |
| 5,551,838 | A | 9/1996 | Hugbart | |
| 5,884,589 | A | 3/1999 | Sakamoto et al. | |
| 5,938,527 | A | 8/1999 | Oshima et al. | |
| 6,017,191 | A | 1/2000 | Harmsen | |
| 6,038,879 | A | 3/2000 | Turcotte et al. | |
| 6,101,829 | A | 8/2000 | Robinson | |
| 6,139,265 | A | 10/2000 | Alizadeh | |
| 6,195,983 | B1 | 3/2001 | Wadia et al. | |
| 6,398,492 | B1 * | 6/2002 | Cho | F04D 29/544 415/191 |
| 6,540,479 | B2 * | 4/2003 | Liao | F04D 29/542 361/697 |
| 6,663,342 | B2 | 12/2003 | Huang et al. | |
| 6,910,862 | B2 * | 6/2005 | Horng | F04D 29/667 415/211.2 |
| 6,997,678 | B2 | 2/2006 | Sun | |
| 7,220,102 | B2 * | 5/2007 | Cho | F04D 29/544 415/211.2 |
| 7,334,988 | B2 * | 2/2008 | Horng | F04D 29/667 415/211.2 |
| 7,377,751 | B2 | 5/2008 | Foster, Sr. et al. | |
| 7,416,386 | B2 | 8/2008 | Ho et al. | |
| 7,481,615 | B2 * | 1/2009 | Park | F04D 29/164 123/41.49 |
| 7,618,233 | B2 | 11/2009 | Parker et al. | |
| 7,789,622 | B2 | 9/2010 | Acre | |
| 7,824,154 | B2 | 11/2010 | Yabuuchi | |
| 7,942,627 | B2 * | 5/2011 | Jin | F04D 19/007 415/199.4 |
| 8,056,352 | B2 | 11/2011 | Kang et al. | |
| 8,087,878 | B2 * | 1/2012 | Chen | F04D 25/088 415/98 |
| 8,157,513 | B2 * | 4/2012 | Takeshita | F04D 29/544 415/121.1 |
| 8,197,198 | B2 * | 6/2012 | Miyabara | F04D 19/007 415/199.5 |
| 8,333,559 | B2 | 12/2012 | Bushnell | |
| 8,393,158 | B2 | 3/2013 | Conners | |
| 8,491,270 | B2 | 7/2013 | Eguchi et al. | |
| 8,573,343 | B2 | 11/2013 | Komatsu et al. | |
| 8,622,695 | B2 | 1/2014 | Decker et al. | |
| 8,696,305 | B2 | 4/2014 | Farlow et al. | |
| 8,740,562 | B2 | 6/2014 | Takemoto et al. | |
| 8,821,123 | B2 | 9/2014 | Camci et al. | |
| 8,887,486 | B2 | 11/2014 | Rosen et al. | |
| 9,033,656 | B2 | 5/2015 | Mizumi et al. | |
| 9,334,877 | B2 | 5/2016 | Nicholls | |
| 9,850,914 | B2 | 12/2017 | Dreesen | |
| 9,945,391 | B2 * | 4/2018 | Hausmann | F04D 19/002 |
| 10,094,394 | B2 * | 10/2018 | Heli | F04D 29/542 |
| 10,190,601 | B2 * | 1/2019 | Dygert | F04D 29/164 |
| 10,227,988 | B2 * | 3/2019 | Gao | A01G 20/47 |
| 10,428,829 | B2 * | 10/2019 | Gebert | F04D 29/544 |
| 2002/0159883 | A1 | 10/2002 | Simon et al. | |
| 2005/0042089 | A1 * | 2/2005 | Horng | F04D 29/667 415/220 |
| 2005/0186070 | A1 * | 8/2005 | Zeng | F04D 29/544 415/211.2 |
| 2005/0191955 | A1 * | 9/2005 | Horng | F04D 29/667 454/184 |
| 2006/0067816 | A1 | 3/2006 | Chang et al. | |
| 2006/0147304 | A1 * | 7/2006 | Cho | F04D 29/544 415/191 |
| 2006/0216147 | A1 * | 9/2006 | Park | F04D 29/164 415/220 |
| 2007/0031248 | A1 | 2/2007 | Hsu et al. | |
| 2007/0154308 | A1 * | 7/2007 | Yang | F04D 29/384 415/220 |
| 2011/0064571 | A1 | 3/2011 | Lind et al. | |
| 2013/0017081 | A1 | 1/2013 | Andrews | |
| 2013/0051997 | A1 * | 2/2013 | Uchiyama | F04D 19/007 415/193 |
| 2013/0315737 | A1 * | 11/2013 | Dygert | F04D 29/526 416/179 |
| 2015/0030445 | A1 | 1/2015 | Gonidec et al. | |
| 2015/0065029 | A1 | 3/2015 | Leckelt et al. | |
| 2015/0098817 | A1 | 4/2015 | Innocenti | |
| 2015/0104303 | A1 | 4/2015 | Velthuis | |
| 2015/0275918 | A1 * | 10/2015 | Hausmann | F04D 29/542 415/1 |
| 2015/0330411 | A1 * | 11/2015 | Heli | F04D 29/542 415/208.2 |
| 2015/0354598 | A1 * | 12/2015 | Dygert | F04D 29/164 415/208.2 |
| 2015/0354841 | A1 * | 12/2015 | Amr | F24F 1/0029 454/233 |
| 2017/0260985 | A1 * | 9/2017 | Gao | F04D 29/325 |
| 2018/0087513 | A1 * | 3/2018 | Hoffman | F04D 29/329 |
| 2018/0106267 | A1 * | 4/2018 | Gebert | F15D 1/02 |
| 2019/0226688 | A1 | 7/2019 | Dygert et al. | |

FOREIGN PATENT DOCUMENTS

| | | | |
|---|---|---|---|
| EP | 2565467 | A2 | 6/2013 |
| EP | 2904277 | A2 | 8/2015 |
| GB | 2433772 | A | 4/2007 |
| JP | 2001182692 | A | 7/2001 |
| JP | 2011185166 | A | 9/2011 |
| JP | 2014020235 | A | 2/2014 |

(56) References Cited

FOREIGN PATENT DOCUMENTS

| | | | |
|---|---|---|---|
| WO | 2014056657 | A2 | 4/2014 |
| WO | 2014109850 | A1 | 7/2014 |
| WO | 2017192644 | A1 | 11/2017 |
| WO | 2017192647 | A1 | 11/2017 |

OTHER PUBLICATIONS

International Search Report for International Application No. PCT/US2017/030728; International Filing Date May 3, 2017; dated Sep. 14, 2017; 7 Pages.

International Search Report for International Application No. PCT/US2017/030732; International Filing Date May 3, 2017; dated Sep. 14, 2017; 7 Pages.

Written Opinion for International Application No. PCT/US2017/030722; International Filing Date May 3, 2017; dated Jul. 14, 2017; 6 Pages.

Written Opinion for International Application No. PCT/US2017/030728; International Filing Date May 3, 2017; dated Sep. 14, 2017; 7 Pages.

Written Opinion for International Application No. PCT/US2017/030732; International Filing Date May 3, 2017; dated Sep. 14, 2017; 9 Pages.

ArchiExpo; CFM; "The Online Architecture and Design Exhibition", BIU Continental Fan Manufacturing Inc., 2019 VirtualExpo; Accessed Online: Dec. 7, 2018; 5 Pages. URL: www.archiexpo.com/prod/continental-fan-manufacturing-inc/product-10072-492474.html.

Ohanian, O., "Ducted Fan Aerodynamics and Modeling, with Applications of Steady and Synthetic Jet Flow Control", Virginia Tech Electronic Theses and Dissertations, May 4, 2011, 203 Pages, Virginia Tech. URL: http://hdl.handle.net/10919/27687.

* cited by examiner

VANE AXIAL FAN WITH INTERMEDIATE FLOW CONTROL RINGS

CROSS REFERENCE TO RELATED APPLICATIONS

This application is a National Stage application of PCT/US2017/030732, filed May 3, 2017, which claims the benefit of U.S. Provisional Application No. 62/330,963, filed May 3, 2016, U.S. Provisional Application No. 62/330,975, filed May 3, 2016, and U.S. Provisional Application No. 62/369,349, filed Aug. 1, 2016, all of which are incorporated by reference in their entirety herein.

BACKGROUND

The subject matter disclosed herein relates to vane axial flow fans. More specifically, the subject matter disclosed herein relates to structures to improve fan stall performance and/or improve stall recovery hysteresis performance of vane axial flow fans.

Vane-axial flow fans are widely used in many industries ranging from automotive to aerospace to HVAC but are typically limited in their application by operating range restrictions and noise considerations. While vane-axial fans can achieve high static efficiencies, their limited operating range due to blade stall typically makes the vane-axial fan impractical for use in many systems that have extended operating range requirements.

SUMMARY

In one embodiment, a fan assembly includes a shrouded fan rotor having a plurality of fan blades extending from a rotor hub and rotatable about a central axis of the fan assembly and a fan shroud extending circumferentially around the fan rotor and secured to an outer tip diameter of the plurality of fan blades. A stator assembly is located downstream of the fan rotor, relative to an airflow direction through the fan assembly. The stator assembly includes a plurality of stator vanes extending between a stator hub and a stator shroud. A flow control ring is positioned between the fan rotor and the stator assembly to block radial flow migration in an axial spacing between the fan rotor and the stator assembly resulting from a radial flow component of an airflow exiting the fan rotor.

Additionally or alternatively, in this or other embodiments the flow control ring is located at between fifty percent and seventy-five percent of a fan blade span.

Additionally or alternatively, in this or other embodiments the flow control ring is formed integral to the stator assembly.

Additionally or alternatively, in this or other embodiments the flow control ring is a separate component from the stator assembly and is mechanically or otherwise fixed to the stator assembly.

Additionally or alternatively, in this or other embodiments the flow control ring extends at least partially along a stator vane chord.

Additionally or alternatively, in this or other embodiments the fan assembly includes two or more flow control rings.

Additionally or alternatively, in this or other embodiments the two or more flow control rings are equispaced across a fan blade span.

In another embodiment, a stator assembly for an axial fan includes a plurality of stator vanes extending between a stator hub and a stator shroud and a flow control ring positioned at a leading edge of the plurality of stator vanes to turn a radially-directed airflow toward an axial direction for entry into the stator assembly.

Additionally or alternatively, in this or other embodiments the flow control ring is located at between fifty percent and seventy-five percent of a fan blade span.

Additionally or alternatively, in this or other embodiments the flow control ring is formed integral to the stator assembly.

Additionally or alternatively, in this or other embodiments the flow control ring is a separate component from the stator assembly and is mechanically or otherwise fixated to the stator assembly.

Additionally or alternatively, in this or other embodiments the flow control ring extends at least partially along a stator vane chord.

Additionally or alternatively, in this or other embodiments the stator assembly includes two or more flow control rings.

Additionally or alternatively, in this or other embodiments the two or more flow control rings are equispaced across a fan blade span.

In yet another embodiment, a method of operating a shrouded axial fan includes urging an airflow through a shrouded fan rotor and flowing the airflow across a flow control ring positioned between the fan rotor and a stator assembly of the shrouded axial fan. The radially directed airflow exiting the shrouded fan rotor is turned toward an axial direction via the flowing across the flow control ring, and the airflow is urged toward a plurality of stator vanes of the stator assembly in a substantially axial direction.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Typically, as a vane-axial fan is throttled back in flow along its operating curve (i.e., operating at increased pressure rise and reduced flow rate relative to a design point), the rotor blade loading increases such that the rotor outlet flow increases in swirl ratio. At the same time, the rotor blades may also begin to experience part-span stall wherein the flow along the radially inboard stations of the blade span separates from the blade suction surface. These two factors tend to increase the radial flow contribution at the rotor outlet, which in turn can result in stall of stator vane passages at a radially inboard portion of the stator vane passages. In addition, this radial flow migration that occurs in the axial spacing between the rotor blade trailing edge and stator vane leading edge can result in reduced rotor stall and stall recovery performance. In certain HVAC applications, such as an indoor fan system for a residential or commercial packaged product or split system, the reduction in operating range driven by this deficient stall/recovery hysteresis performance can hinder the application of vane-axial fan technology.

Figure 1:
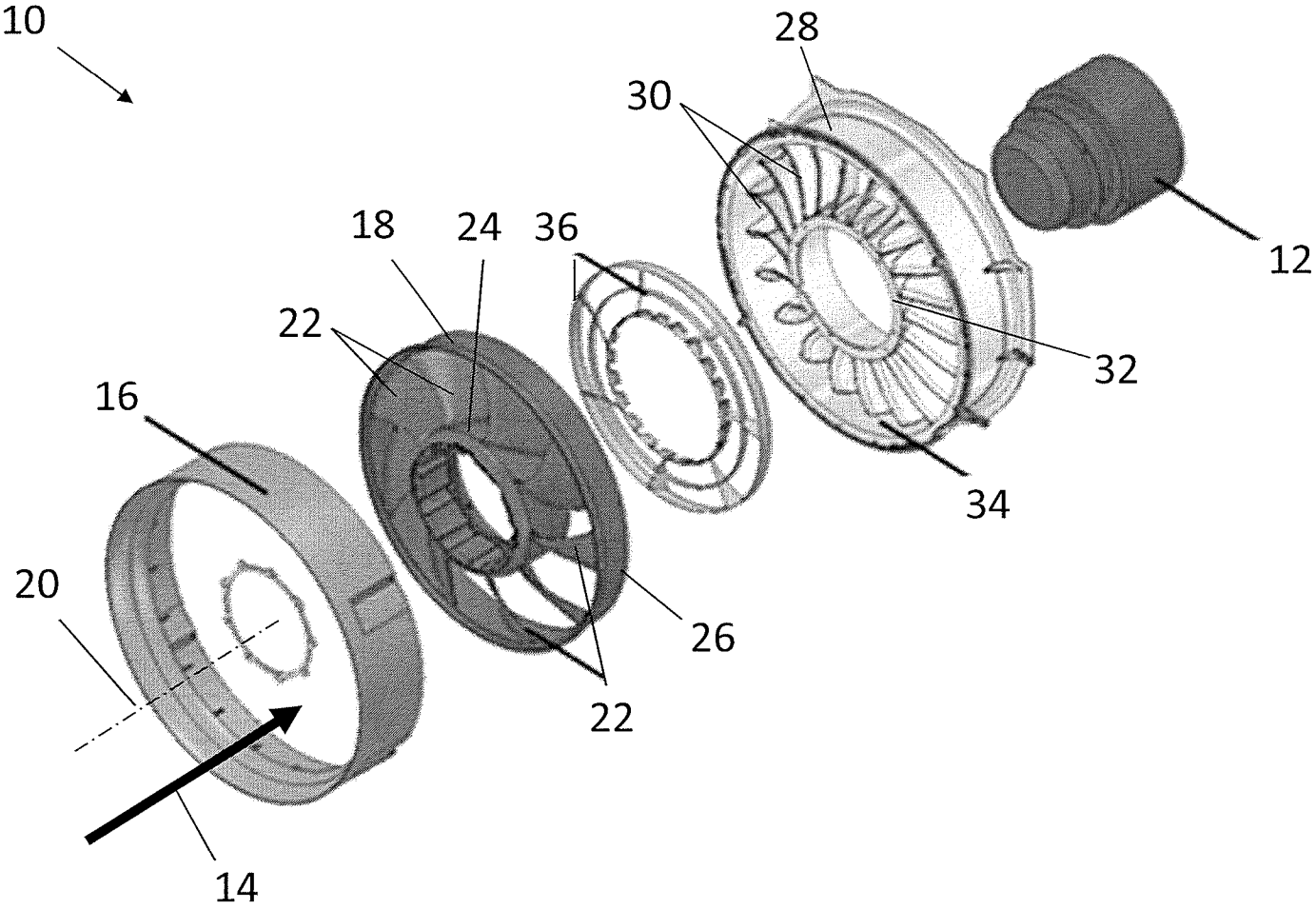
FIG. 1 is a perspective view of an embodiment of a fan assembly.

Shown in FIG. 1 is a partially exploded perspective view of an embodiment of a vane-axial flow fan 10 utilized, for example in a heating, ventilation and air conditioning (HVAC) system as an air handling fan. The fan 10 may be driven by an electric motor 12 connected to the fan 10 by a shaft (not shown), or alternatively a belt or other arrangement. In operation, the motor 12 drives rotation of the fan 10 to urge airflow 14 across the fan 10 and along a flowpath, for example, to and/or from a heat exchanger (not shown). The fan 10 includes a casing 16 with a fan rotor 18, or impeller rotably located in the casing 16. Operation of the motor 12 drives rotation of the fan rotor 18 about a fan axis 20. The fan rotor 18 includes a plurality of fan blades 22 extending from a hub 24 and terminating at a fan shroud 26. The fan shroud 26 is connected to one or more fan blades 22 of the plurality of fan blades 22 and rotates about the fan axis 20 therewith. The fan 10 further includes a stator assembly 28 including a plurality of stator vanes 30, located downstream of the fan rotor 18. The plurality of stator vanes 30 extend substantially radially from a stator hub 32 to a stator shroud 34.

Under some operating conditions, airflow 14 exiting the fan rotor 18 and entering the stator assembly 28 has a significant radially outward component that can result in large area of recirculation at an inboard-span portion of the stator assembly 28, which may result in stall of the stator assembly 28. Furthermore, this radially outward flow migration in the axial spacing between the trailing edge of the fan blades 22 and the leading edge of the stator vanes 30 can recirculate radially to the tip of the fan blades 22 at their termination at the fan shroud 26 such that the stall and stall recovery performance of the fan rotor 18 is degraded.

Figure 2:
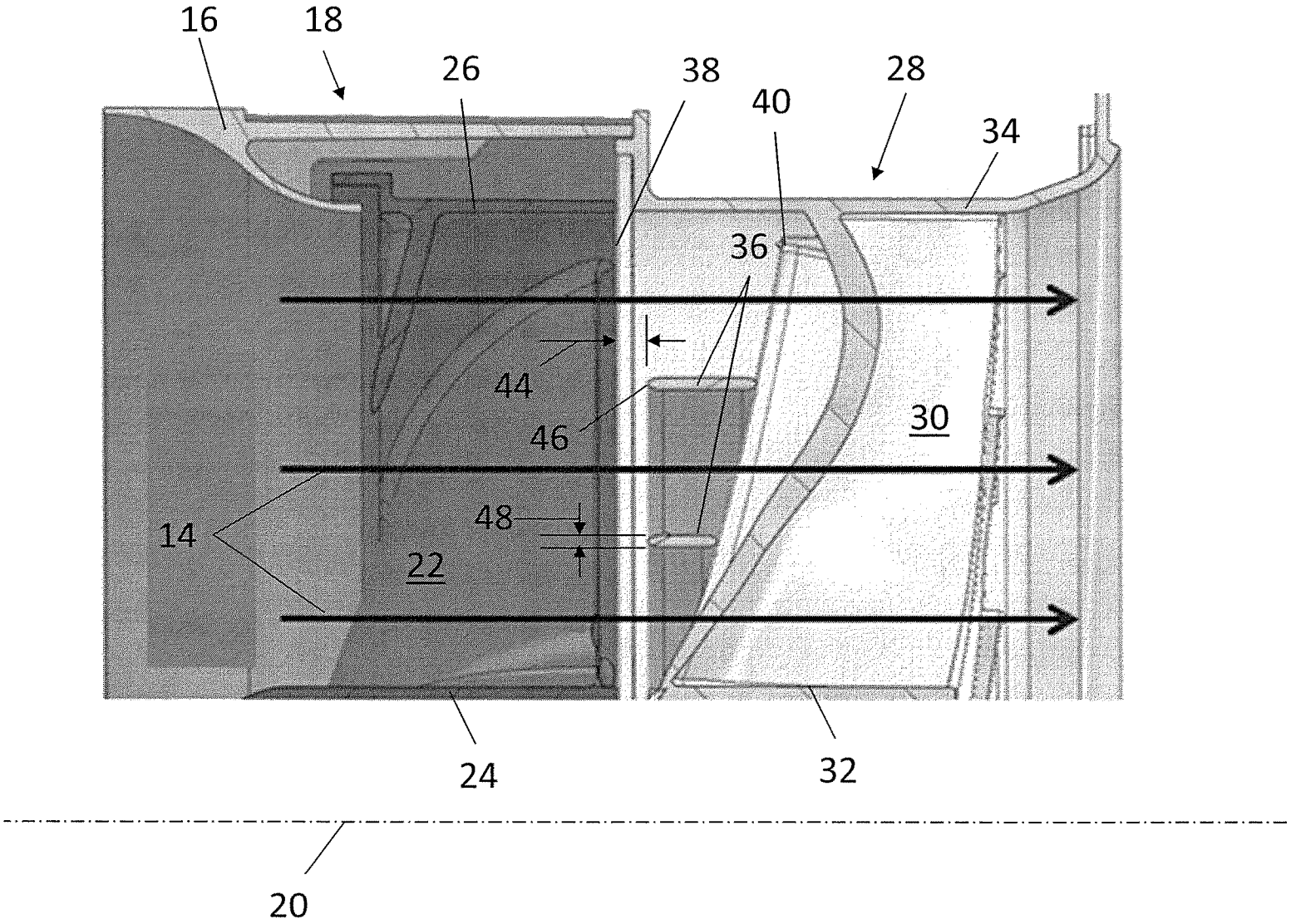
FIG. 2 is a partial cross-sectional view of an embodiment of a fan assembly.
Figure 3:
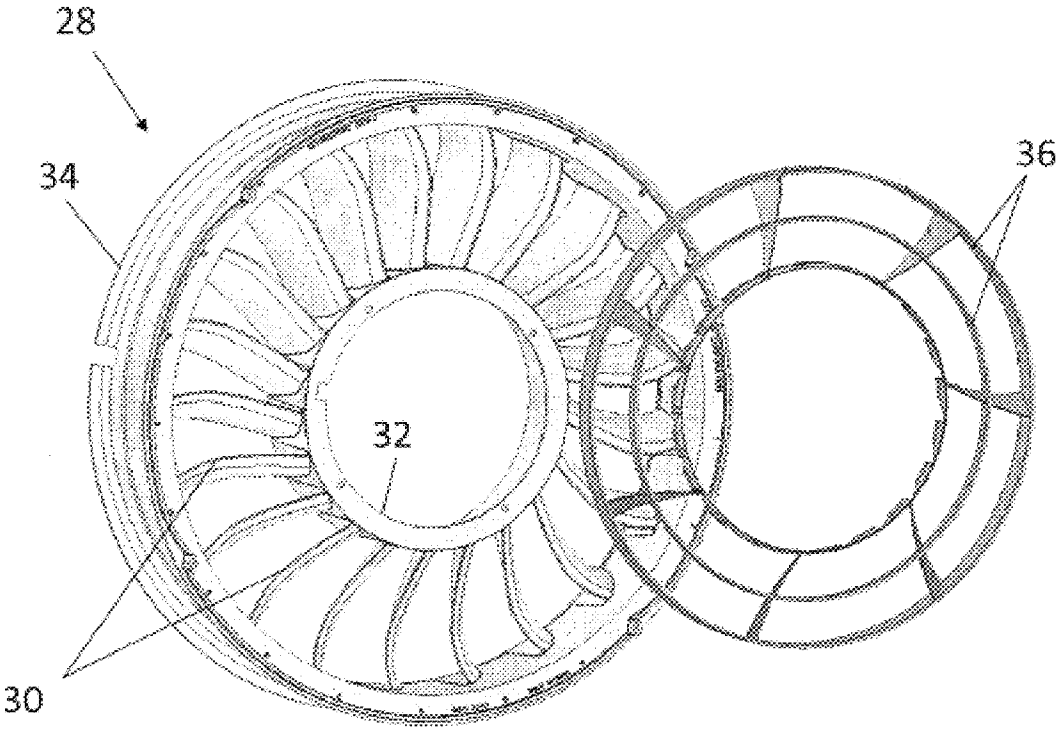
FIG. 3 is a perspective view illustrating an embodiment of a stator assembly with separate flow control rings.
Figure 4:
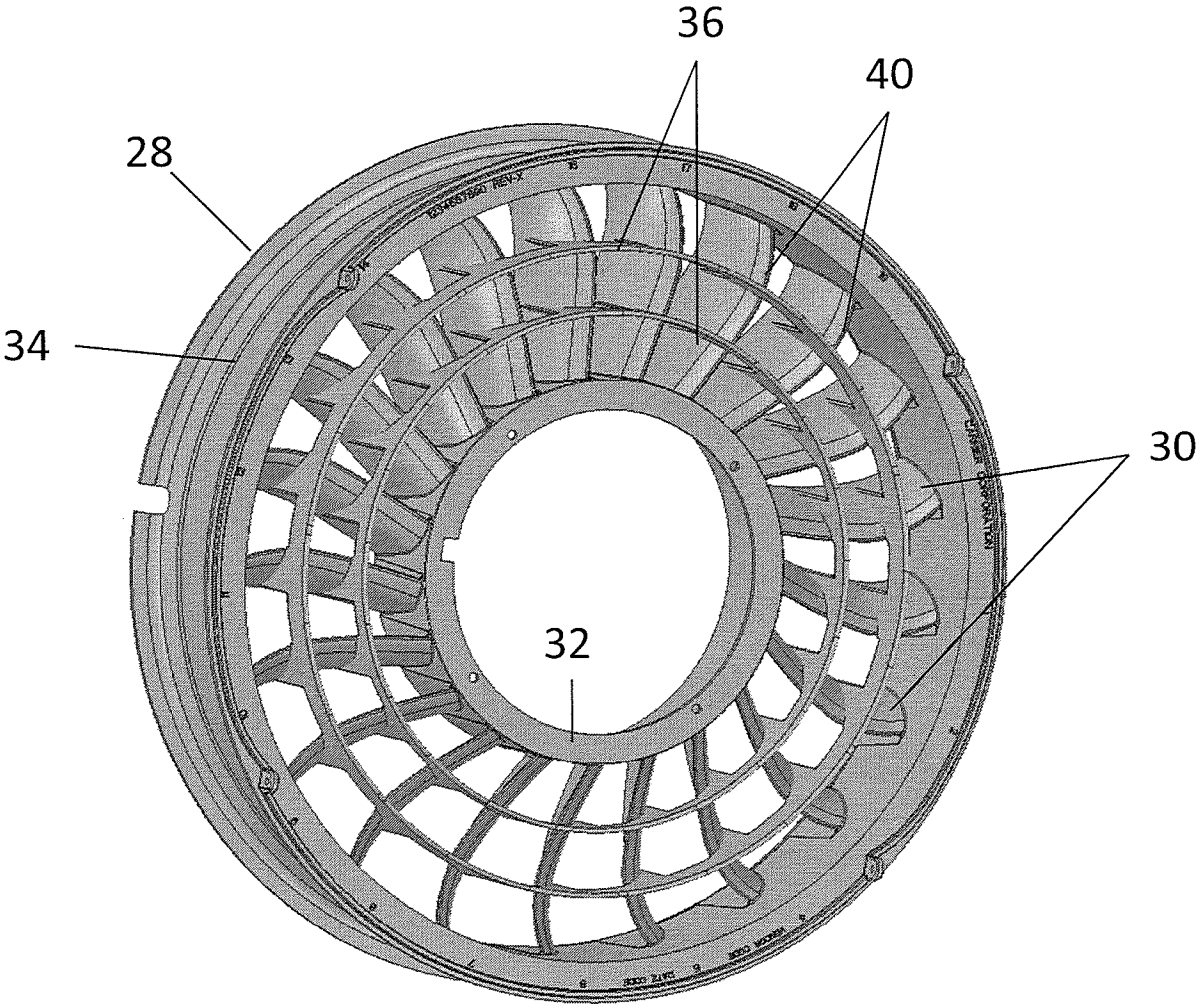
FIG. 4 is a perspective view of an embodiment of a stator assembly with integrally-formed flow control rings.

Referring now to FIG. 2, to mitigate this radial flow migration, thus reducing the potential for stall at the stator assembly 28 and recirculation in the axial spacing between the trailing edge of the fan blades 22 and the leading edge of the stator vanes 30, one or more flow control rings 36 are located between a rotor trailing edge 38 and a stator leading edge 40. The flow control rings 36 are configured to redirect the radial component of airflow 14 into more of an axial direction, reducing the radial component of the airflow 14. As shown best in FIG. 1, the one or more flow control rings 36 extend circumferentially about the fan axis 20 and extend axially at least partially between the rotor trailing edge 38 and the stator leading edge 40 to prevent the radial component of the airflow 14 from disrupting the flow through the stator assembly 28 and from recirculating to and disrupting the flow at the tip of the rotor blades 22. In some embodiments, such as shown in FIG. 3, the flow control rings 36 are formed separately from the stator assembly 28 and are secured to the stator assembly 28 by, for example, snaps or threaded fasteners or other fastening means. Alternatively, as shown in FIG. 4, the flow control rings 36 may be formed integral to the stator assembly as part of, for example, a casting or molded component. Further, while in some embodiments the flow control rings 36 terminate at the stator leading edge 40, in other embodiments, such as shown in FIG. 4, the flow control rings 36 may extend at least partially along a chord of the stator vanes 30.

Referring again to FIG. 2, in some embodiments two flow control rings 36 are utilized, a first flow control ring 36 located at about 33% of rotor span and a second flow control ring 36 located at about 66% of rotor span. In other embodiments, other quantities of flow control rings 36 may be utilized to provide adequate flow control, while minimizing blockage of the flowpath between the fan rotor 18 and the stator assembly 28. For example, in some embodiments a single flow control ring 36 may be utilized, and located at between about 50% and 75% of the rotor span.

The flow control rings 36 are located and configured to have the desired flow modification characteristic, without adversely affecting fan 10 operation and capacity. A rotor gap 44 between the rotor trailing edge 38 and a ring leading edge 46 is between about 0.75% and 2% of the tip diameter of the fan rotor 18 to sufficiently redirect the airflow 14 while providing enough clearance to prevent collision between the fan rotor 28 and the flow control rings 36 under operating conditions of the fan 10. The flow control rings 36 have a radial thickness 48 optimized for structural rigidity and manufacturability, while minimizing blockage of the fan flow area. In some embodiments, the radial thickness 48 is between about 0.5% and 2% of the tip diameter of the fan rotor 18.

The utilization of flow control rings 36 in the fan 10 improves stall performance of the fan 10 and further reduces stall recovery hysteresis in comparison to prior fans. These improvements allow for expansion of the operating envelope of shrouded axial fans, thus increasing their applicability to a wide range of conditions, such as rooftop HVAC&R systems, allowing such systems to take advantage of the performance advantages of shrouded axial fans.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A fan assembly comprising:

a shrouded fan rotor including:

a plurality of fan blades extending from a rotor hub and rotatable about a central axis of the fan assembly; and a fan shroud extending circumferentially around the fan rotor and secured to an outer tip diameter of the plurality of fan blades;

a stator assembly located downstream of the fan rotor, relative to an airflow direction through the fan assembly, the stator assembly including a plurality of stator vanes extending between a stator hub and a stator shroud; and a flow control ring assembly disposed axially between the fan rotor and the stator assembly to block radial flow migration in an axial spacing between the fan rotor and the stator assembly resulting from a radial flow component of an airflow exiting the fan rotor, the flow control ring assembly including:

two or more flow control rings; and a plurality of radially extending supports connecting the two or more flow control rings, the two or more flow control rings and the plurality of supports disposed axially between the fan rotor and the stator assembly;

wherein the two or more flow control rings are spaced across a fan blade span;

wherein an axial gap between a rotor trailing edge of the fan rotor and a ring leading edge of each flow control ring of the two or more flow control rings is between 0.75% and 2% of a tip diameter of the fan rotor.

2. The fan assembly of claim 1, wherein a flow control ring of the two or more flow control rings is located at between fifty percent and seventy-five percent of the fan blade span, as measured from the rotor hub.

3. The fan assembly of claim 1, wherein the two or more flow control rings is formed integral to the stator assembly.

4. The fan assembly of claim 1, wherein the two or more flow control rings is a separate component from the stator assembly and is mechanically or otherwise fixed to the stator assembly.

5. The fan assembly of claim 1, wherein a flow control ring of the two or more flow control rings extends at least partially along a chord of a stator vane of the plurality of stator vanes.

6. A stator assembly for an axial fan, comprising:

a plurality of stator vanes extending between a stator hub and a stator shroud; and a flow control ring assembly disposed upstream of a leading edge of the plurality of stator vanes to turn a radially directed airflow toward an axial direction for entry into the stator assembly, the flow control ring assembly including:

two or more flow control rings; and a plurality of radially extending supports connecting the two or more flow control rings, the two or more flow control rings and the plurality of supports disposed axially upstream of the plurality of stator vanes;

wherein the two or more flow control rings are spaced across a fan blade span of the axial fan;

wherein the flow control ring assembly is configured to be positioned axially between a fan rotor of the axial fan and the plurality of stator vanes, such that the fan rotor is axially upstream of the flow control ring assembly;

wherein an axial gap between a rotor trailing edge of the fan rotor and a ring leading edge of each flow control ring of the two or more flow control rings is between 0.75% and 2% of a tip diameter of the fan rotor.

7. The stator assembly of claim 6, wherein a flow control ring of the two or more flow control rings is located at between fifty percent and seventy-five percent of the fan blade span of the axial fan, as measured from a fan blade root.

8. The stator assembly of claim 6, wherein the two or more flow control rings is formed integral to the stator assembly.

9. The fan assembly of claim 6, wherein the two or more flow control rings is a separate component from the stator assembly and is mechanically or otherwise fixated to the stator assembly.

10. The stator assembly of claim 6, wherein a flow control ring of the two or more flow control rings extends at least partially along a chord of a stator vane of the plurality of stator vanes.

11. A method of operating a shrouded axial fan, comprising:

urging an airflow through a shrouded fan rotor;

flowing the airflow across a flow control ring assembly disposed axially between the fan rotor and a stator assembly of the shrouded axial fan, the flow control ring assembly including:

two or more flow control rings; and a plurality of radially extending supports connecting the two or more flow control rings, the two or more flow control rings and the plurality of supports disposed axially upstream of the plurality of stator vanes;

turning the radially directed airflow exiting the shrouded fan rotor toward an axial direction via the flowing across the two or more flow control rings; and urging the airflow toward a plurality of stator vanes of the stator assembly in a substantially axial direction;

wherein the two or more flow control rings are spaced across a fan blade span;

wherein an axial gap between a rotor trailing edge of the fan rotor and a ring leading edge of each flow control ring of the two or more flow control rings is between 0.75% and 2% of a tip diameter of the fan rotor.

* * * * *